US006530097B1

(12) United States Patent
Sung

(10) Patent No.: US 6,530,097 B1
(45) Date of Patent: Mar. 11, 2003

(54) STONE-TOP SINK BOARD ARRANGEMENT

(76) Inventor: Chen Sung, 318 N. Third St., #D, Alhambra, CA (US) 91801

( * ) Notice: Subject to any disclaimer, the term of this patent is extended or adjusted under 35 U.S.C. 154(b) by 0 days.

(21) Appl. No.: 10/016,442

(22) Filed: Dec. 11, 2001

(51) Int. Cl.[7] ..... E03C 1/33
(52) U.S. Cl. ..... 4/631
(58) Field of Search ..... 4/631–636

(56) References Cited

U.S. PATENT DOCUMENTS 1,880,733 A * 10/1932 Bolhuis ..... 4/630 X
6,128,793 A * 10/2000 Weinstein ..... 4/631
6,349,429 B1 * 2/2002 Zurba et al. ..... 4/631 X

* cited by examiner

*Primary Examiner*—Charles E. Phillips
(74) *Attorney, Agent, or Firm*—Raymond Y. Chan; David and Raymond Patent Group

(57) ABSTRACT

A stone-top sink board arrangement includes a sink board having a through hole, a reinforcing panel overlappedly mounted underneath the sink board, wherein the reinforcing panel has a guiding hole coaxially aligning with the through hole of the sink board, a mounting unit arranged for securely mounting the top surrounding edge of the bowl to the reinforcing panel, and at least two supporting flanges. Therefore, by securely mounting on inner sides of two supporting walls respectively of a cabinet, the reinforcing panel is substantially supported on the supporting flanges while the sink board is sitting on top of the cabinet.

20 Claims, 6 Drawing Sheets

STONE-TOP SINK BOARD ARRANGEMENT

SUMMARY OF THE PRESENT INVENTION

A main object of the present invention is to provide a stone-top sink board arrangement which comprises a reinforcing panel to enhance the strength of stone made sink board, so as to substantially support the sink board and evenly distribute the force applied thereon.

Another object of the present invention is to provide a stone-top sink board arrangement which can reduce the thickness of the sink board for reducing an overall weight thereof, so as to reduce the cost of the sink board and enhance the portability thereof.

Another object of the present invention is to provide a stone-top sink board arrangement, wherein the sink board and the bowl can be pre-assembled in the factory for mass production, so as to further reduce the manufacturing cost of the sink board.

Another object of the present invention is to provide a stone-top sink board arrangement, which has a simple construction that every individual is able to install the sink board into the cabinet.

Accordingly, in order to accomplish the above objects, the present invention provides a stone-top sink board arrangement for mounting a bowl having a top surrounding edge thereto, said arrangement being supported on top of a cabinet comprising two supporting walls spaced apart from each other to define a bowl cavity having a top opening, comprising:

a sink board being made of stone and having a through hole;

reinforcing panel, having a size smaller than that of the sink board, firmly mounted underneath the sink board, wherein the reinforcing panel has a guiding hole coaxially aligning with the through hole of the sink board and a diameter of the guiding hole is larger than that of the through hole of the sink board so as to define a holding groove positioning within an circumferential edge of the guiding hole, so as to securely hold the top surrounding edge of the bowl within the holding groove; and at least two supporting flanges securely mounted on inner sides of the two supporting walls respectively in predetermined positions that a bottom surface of the reinforcing panel is substantially supported on the supporting flanges while the sink board is sitting on top of the cabinet.

DETAILED DESCRIPTION OF THE PREFERRED EMBODIMENT

Figure 1:
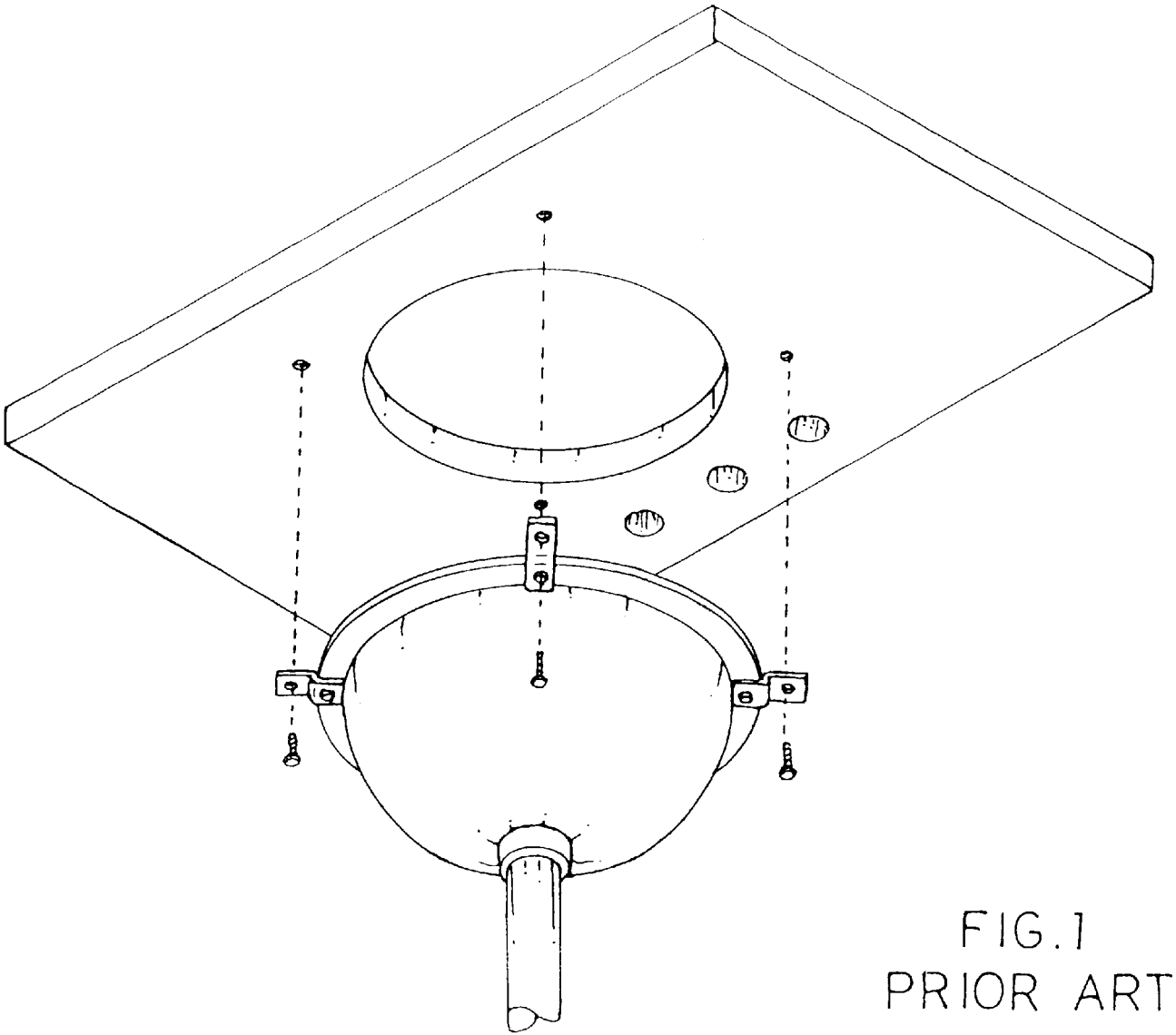
FIG. 1 PRIOR ART
FIG. 1 is a perspective view of a convention sink board, illustrating a bowl being directly mounted underneath the sink board.
Figure 2:
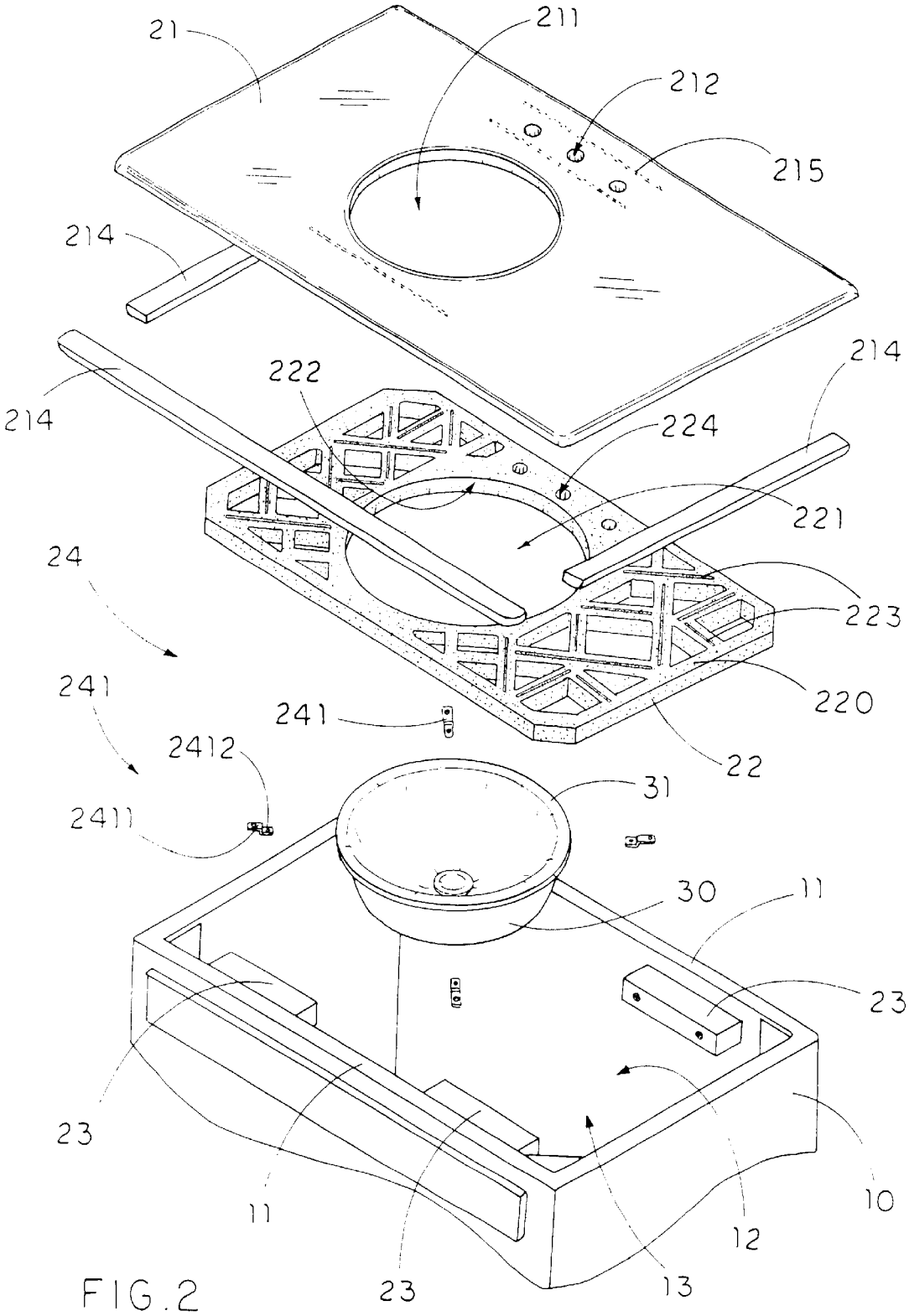
FIG. 2 is an exploded perspective view of a stone-top sink board arrangement according to a preferred embodiment of the present invention.
Figure 3:
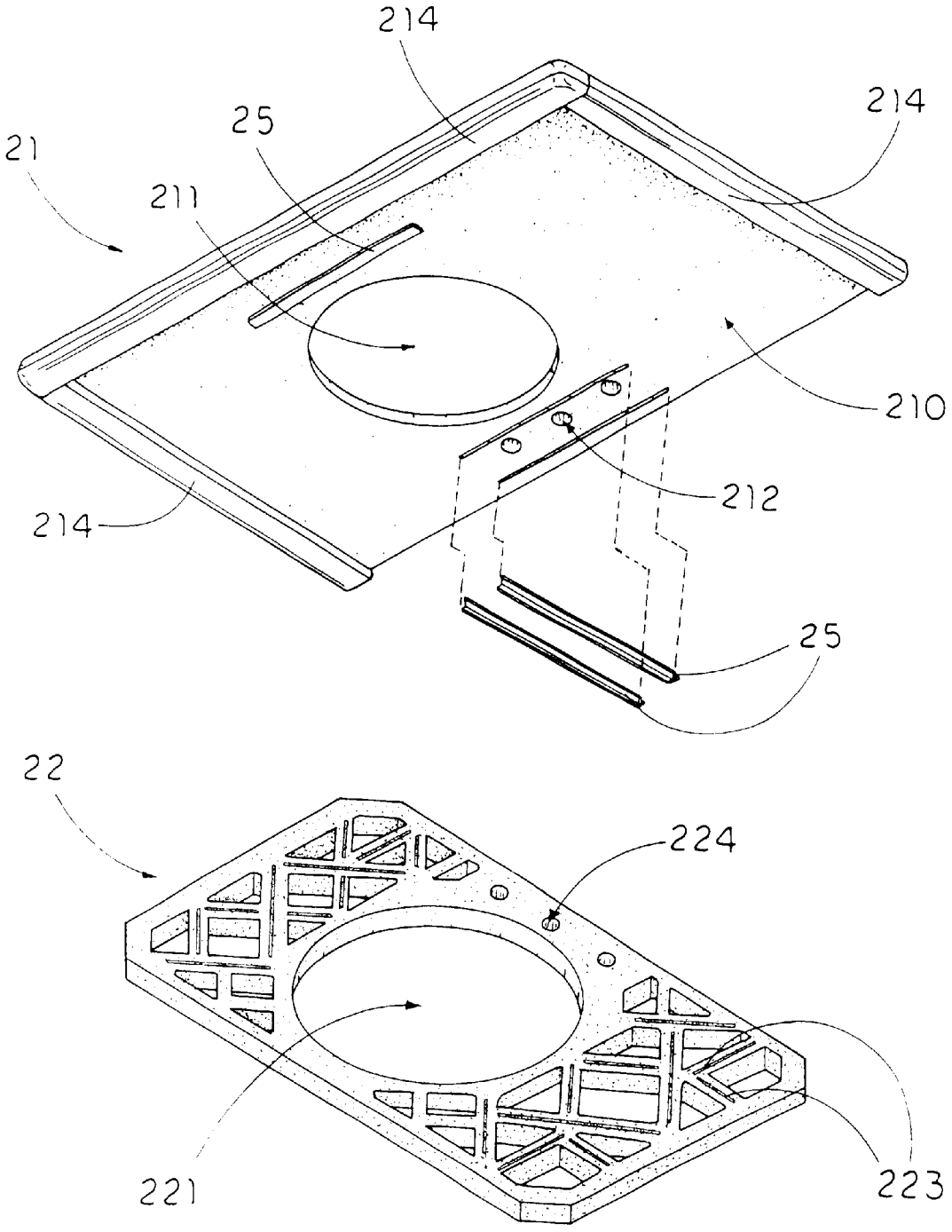
FIG. 3 is a perspective view of a reinforcing panel of the stone-top sink board according to the above preferred embodiment of the present invention.

Referring to FIG. 2 of the drawings, a stone-top sink board arrangement 20 according to a preferred embodiment of the present invention is illustrated, wherein the stone-top sink board arrangement 20 is arranged to mount a bowl 30 having a top surrounding edge 31 thereto and to support on top of a cabinet 10 having two supporting walls 11 spaced apart with each other to define a bowl cavity 12 having a top opening 13.

The stone-top sink board arrangement 20 comprises a sink board 21 having a through hole 211 and a reinforcing panel 22, having a size smaller than that of the sink board 21, overlappedly mounted underneath the sink board 21.

The reinforcing panel 22 has a guiding hole 221 coaxially aligning with the through hole 211 of the sink board 21 and a diameter of the guiding hole 221 is larger than that of the through hole 211 of the sink board 21 so as to define a holding groove 222 positioning within a circumferential edge of the guiding hole 221 for securely holding the top surrounding edge 31 of the bowl 30 within the holding groove 222.

The stone-top sink board arrangement 20 further comprises at least two supporting flanges 23 securely mounted on inner sides of the two supporting walls 11 respectively in predetermined positions that a bottom surface of the reinforcing panel 22 is substantially supported on the supporting flanges 23 while the sink board 21 is sitting on top of the cabinet 10.

According to the preferred embodiment, the sink board 21, which is made of stone, has a predetermined thickness thinner than a conventional stone made sink board, wherein the sink board 21 has a size larger than a distance between the two supporting walls 11 such that the sink board 21 is adapted to enclose the top opening 13 of the cabinet 10 when the sink board 21 is supported thereon. The sink board 21 further has at least a faucet through hole 212 provided thereon.

The reinforcing panel 22 has a size smaller than that of the sink board 21 to fittedly dispose in the bowl cavity 12 when the sink board 21 is supported on the cabinet 10. The reinforcing panel 22 is made of stiff material such as plastic or plywood that provides a rigid support for the sink board 21. Therefore, the thickness of the sink board 21 can be substantially reduced without decreasing the strength thereof, so as to minimize the material cost of the sink board 21. The reinforcing panel 22 further has at least a faucet positioning hole 224 provided thereon and coaxially aligned with the faucet through hole 212 of the sink board 21 in such a manner that the faucet 32 can be mounted on the sink board 21 through the faucet through hole 212 and the faucet positioning hole 224 for communicating with the bowl cavity 12.

In order to firmly affix the reinforcing panel 22 underneath the sink board 21, the reinforcing panel 22 has a top surface 220 provided with adhesive material to firmly affix to a coarse bottom source 210 of the sink board 21. The reinforcing panel 22 further has a plurality of receiving grooves 223 provided on the top surface 220 thereof such that more adhesive material can be applied on the top surface 220 of the reinforcing panel 22 to enhance the adhesive ability of the reinforcing panel 22.

Accordingly, the diameter of the guiding hole 221 of the reinforcing panel 22 is larger than a diameter of the top shoulder edge 31 of the bowl 30 such that the top shoulder edge 31 of the bowl 30 fittedly passes through the guiding hole 221 of the reinforcing panel 22 within the holding groove 222 until the top shoulder edge 31 of the bowl 30 biases against the bottom surface 210 of a circumferential edge portion of the through hole 211 of the sink board 21.

Figure 4:
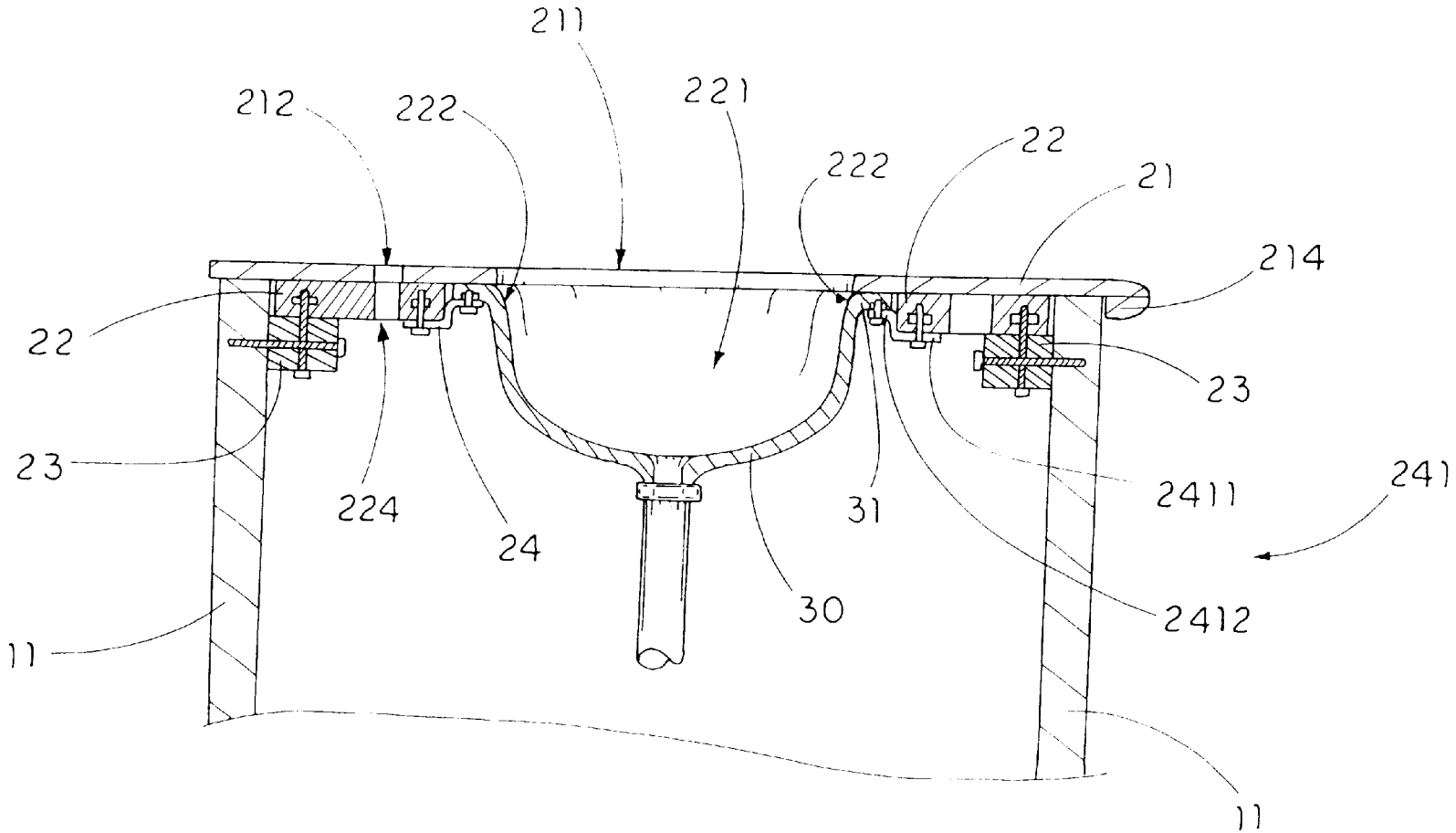
FIG. 4 is a sectional view of the stone-top sink board arrangement mounted on a cabinet according to the above preferred embodiment of the present invention.

As shown in FIG. 4, each of the support flange 23, having a predetermined width, is securely affixed to the inner side of the respective supporting wall 11 of the cabinet 10 at a predetermined position that the bottom surface of the reinforcing panel 22 is substantially supported on the supporting flange 23 while the sink board 21 is sitting on top of the cabinet 10.

As shown in FIG. 2, there are two pairs of supporting flanges 23 mounted on the inner side of the supporting walls 11 respectively so as to rigidly support the reinforcing panel 22 within the bowl cavity 12. Therefore, a downward force applied on the sink board 21 can be evenly distributed throughout the entire cabinet 10. In other words, the sink board 21 is more rigid and capable of supporting more weight in comparison with the conventional sink board having a thicker size.

The stone-top sink board arrangement 20 further comprises a mounting unit 24 comprising at least two mounting members 241 for securely locking the top surrounding edge 31 of the bowl 30 within the holding groove 222 wherein each of the mounting members has an affixing portion 2411 securely mounted on the bottom surface of the reinforcing panel 22 and a biasing portion 2412 integrally extended from the affixing portion 2411 to the holding groove 222 for biasing against a bottom surface of the top surrounding edge 31 of the bowl 30, as shown in FIG. 4. Therefore, the user is able to self-install the bowl 30 into the stone-top sink board arrangement 20 by such simple and easy attaching construction.

When the faucet through hole 212 is formed on the sink board 21, the rigid structure of the sink board 21 may be reduced. In other words, the sink board 21 may easily be cracked around the faucet through hole 212 since the stress is created around the faucet through hole 212 when the faucet 32 is mounted on the sink board 21. In order to reinforce the strength of the sink board 21, the stone-top sink board arrangement 20 further comprises at least an elongated reinforcing element 25 which is made of stiffness material such as steel embedded into the bottom surface 210 of the sink board 21 and positioned adjacent to the faucet through hole 212 for substantially enhancing the stiffness of the sink board 21, so as to minimize the stress around the faucet through hole 212. Of course, more than one reinforcing element 25 can be embedded into the sink board 21 and positioned adjacent to the through hole 211 to minimize the stress around the through hole 211, as shown in FIG. 2.

As shown in FIG. 2, the sink board 21 further comprises a protecting edge 214, having a predetermined width, firmly affixed to the bottom surface 210 of an outer edge portion of the sink board 21 so as to form round circumferential edge of the sink board 21. Therefore, the protecting edge 214 is adapted to not only protect the outer circumferential edge of the sink board 21 by enhancing the stiffness thereof but also keep the aesthetic appearance of the sink board 21.

Figure 5:
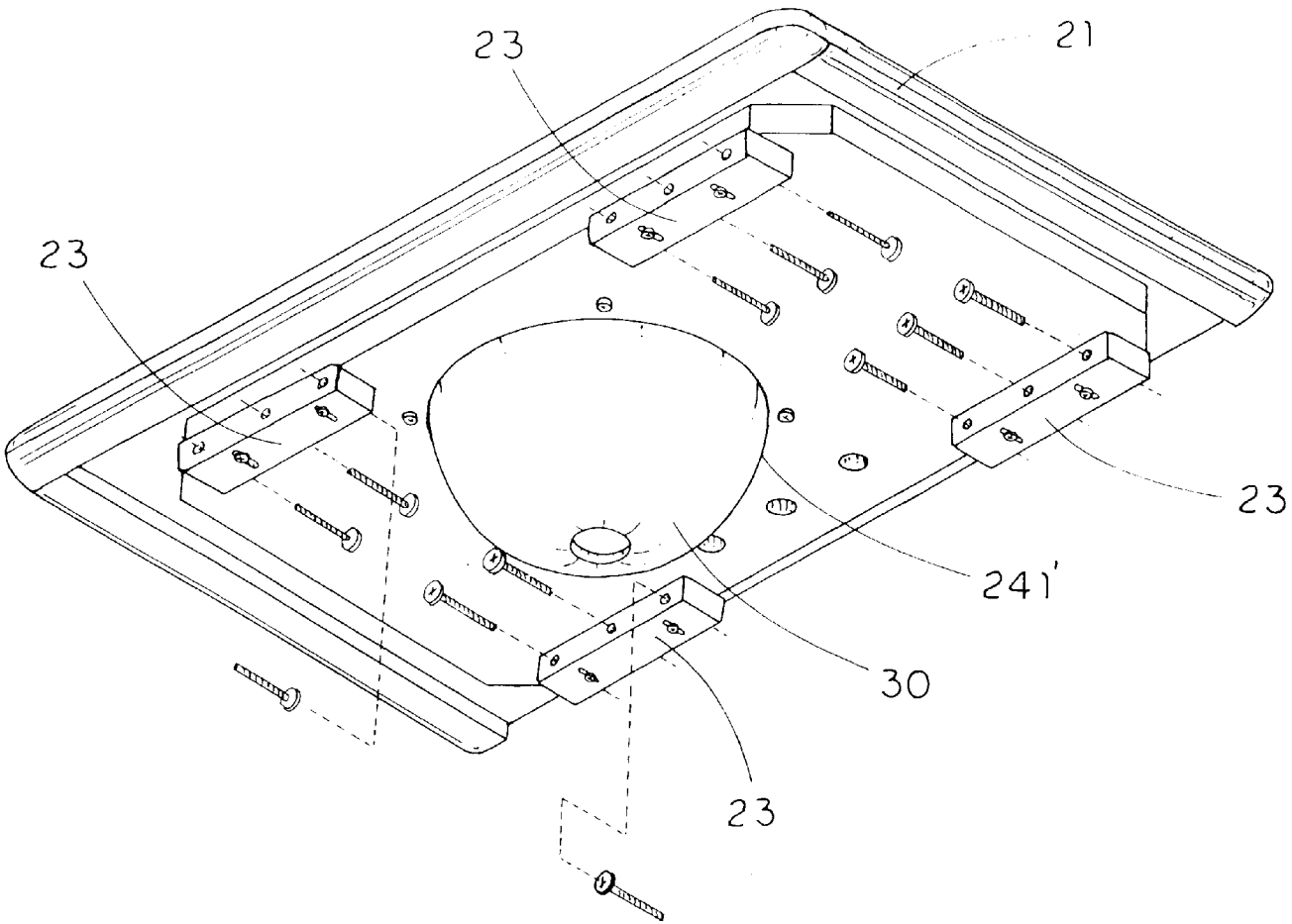
FIG. 5 illustrates an alternative mode of a mounting unit of the stone-top sink board arrangement according to the above preferred embodiment of the present invention.
Figure 6:
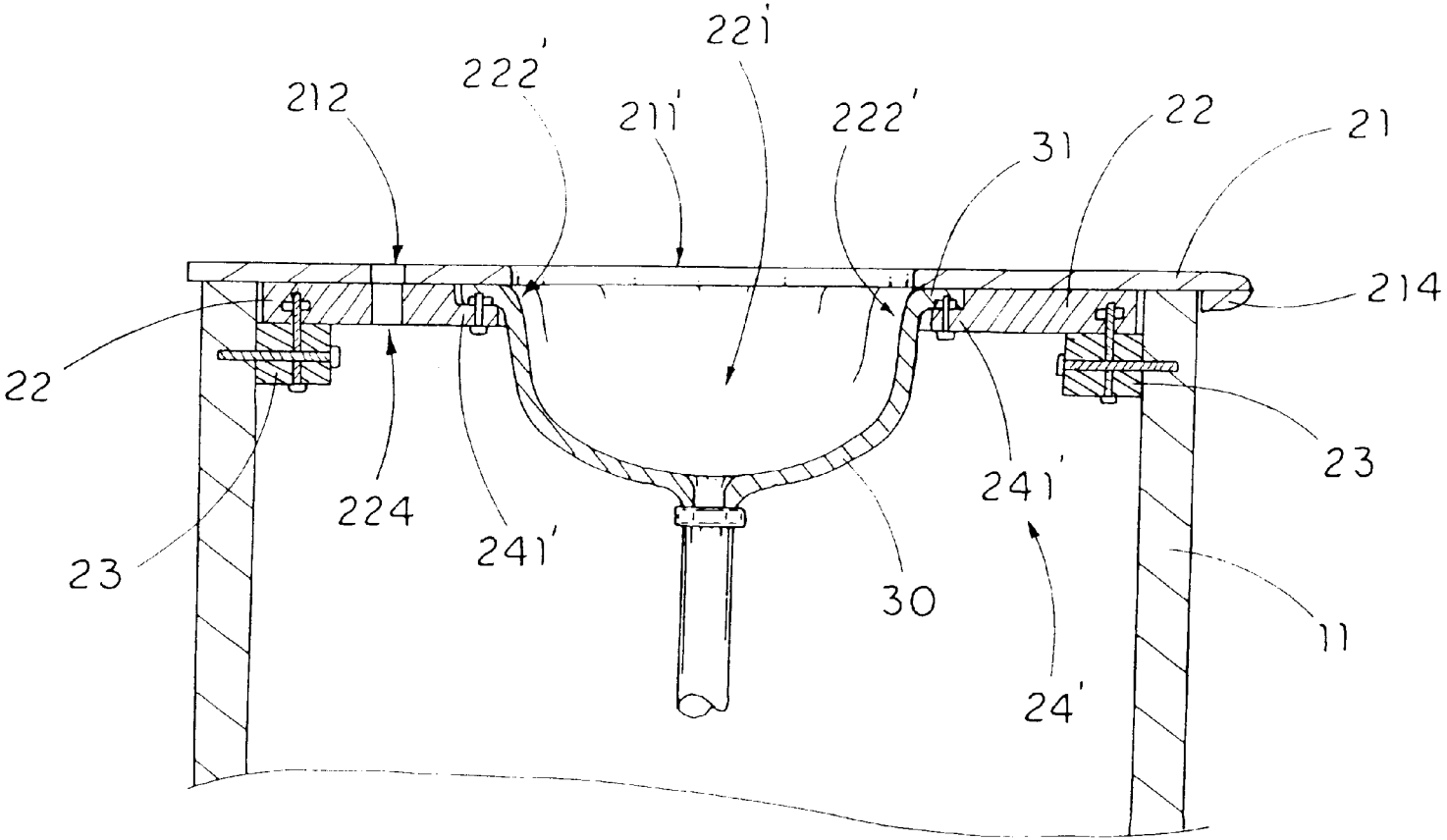
FIG. 6 is a sectional view of the stone-top sink board arrangement according to alternative mode of the preferred embodiment of the present invention.

FIG. 5 illustrates an alternative mode of mounting unit 24' which comprises a ring-shaped mounting panel 241', having a thickness thinner than the thickness of the reinforcing panel 22, integrally and radially extended from the circumferential edge of the guiding hole 221 so as to define the holding groove 222' between the mounting panel 241' and the sink board 21, as shown in FIG. 6. Therefore, the top surrounding edge 31 of the bowl 30 can be securely held within the holding groove 22'. It is worth to mention that the bowl 30 is pre-assembled to the stone-top sink board arrangement 20 for mass production so as to further reduce a step of installing the bowl 30 into the stone-top sink board arrangement 20 for the user. In other words, the user is able to purchase the stone-top sink board arrangement 20 with the bowl 30 mounted thereto such that the user can directly mount the stone-top sink board arrangement 20 on the cabinet 10 without pre-installation of the bowl 30.

In order to quickly and easily install the present invention, the supporting flanges 23 are held on the bottom surface of the reinforcing panel 22 in position such that the user is able to place the sink board 21 on top of the cabinet 10 and then attach each of the supporting flanges 23 to the respective supporting wall 11 by transversely screwing a screw or other connecting device to the supporting wall 11 through the supporting flange 23.

What is claimed is:

1. A stone-top sink board arrangement for mounting a bowl having a top surrounding edge thereto, said arrangement being supported on top of a cabinet comprising two supporting walls spaced apart from each other to define a bowl cavity having a top opening, comprising:

a sink board being made of stone and having a through hole;

a reinforcing panel, having a size smaller than that of said sink board, overlappedly attached to a bottom surface of said sink board, wherein said reinforcing panel has a guiding hole coaxially aligned with said through hole of said sink board and being shaped so as to provide for contact of said top surrounding edge of said bowl with said bottom surface of said sink board by a mounting unit; and at least two supporting flanges securely mounted on inner sides of said two supporting walls respectively in predetermined positions that a bottom surface of said reinforcing panel is substantially supported on said supporting flanges while said sink board is sitting on top of said cabinet.

2. The stone-top sink board arrangement, as recited in claim 1, wherein a diameter of said guiding hole of said reinforcing panel is larger than that of said through hole of said sink board to define a holding groove positioning within an circumferential edge of said guiding hole, so as to hold said top surrounding edge of said bowl within said holding groove.

3. The stone-top sink board arrangement, as recited in claim 2, wherein said sink board further has at least a faucet through hole and said reinforcing panel further has at least a faucet positioning hole coaxially aligned with said faucet through hole of said sink board for mounting a faucet on said sink board and communicating with said bowl cavity through said faucet through hole.

4. The stone-top sink board arrangement, as recited in claim 3, further comprising at least an elongated reinforcing element embedded into said bottom surface of said sink board and positioned adjacent to said faucet through hole for substantially enhancing a stiffness of said sink board around said faucet through hole.

5. The stone-top sink board arrangement, as recited in claim 2, wherein said reinforcing panel has a top surface provided with an adhesive material to firmly affix to said bottom surface of said sink board having a coarse structure.

6. The stone-top sink board arrangement, as recited in claim 5, wherein said mounting unit comprises at least two mounting members each having an affixing portion securely mounted on said bottom surface of said reinforcing panel and a biasing portion integrally extended from said affixing portion to said holding groove for biasing against a bottom surface of said top surrounding edge of the bowl.

7. The stone-top board arrangement, as recited in claim 5, wherein said mounting unit comprises a ring-shaped mounting panel, having a thickness thinner than a thickness of said reinforcing panel, integrally and radially extended from said circumferential edge of said guiding hole so as to define said holding groove between said mounting panel and said sink board to securely hold said top surrounding edge of said bowl.

8. The stone-top sink board arrangement, as recited in claim 5, wherein said reinforcing panel further has a plurality of receiving grooves provided on said top surface of said reinforcing panel for receiving said adhesive material, so as to enhance an adhesive ability of said reinforcing panel.

9. The stone-top sink board arrangement, as recited in claim 1, wherein said sink board further has at least a faucet through hole and said reinforcing panel further has at least a faucet positioning hole coaxially aligned with said faucet through hole of said sink board for mounting a faucet on said sink board and communicating with said bowl cavity through said faucet through hole.

10. The stone-top sink board arrangement, as recited in claim 9, further comprising at least an elongated reinforcing element embedded into said bottom surface of said sink board and positioned adjacent to said faucet through hole for substantially enhancing a stiffness of said sink board around said faucet through hole.

11. The stone-top sink board arrangement, as recited in claim 8, wherein said sink board further has at least a faucet through hole and said reinforcing panel further has at least a faucet positioning hole coaxially aligned with said faucet through hole of said sink board for mounting a faucet on said sink board and communicating with said bowl cavity through said faucet through hole.

12. The stone-top sink board arrangement, as recited in claim 11, further comprising at least an elongated reinforcing element embedded into said bottom surface of said sink board and positioned adjacent to said faucet through hole for substantially enhancing a stiffness of said sink board around said faucet through hole.

13. The stone-top sink board arrangement, as recited in claim 12, wherein said mounting unit comprises at least two mounting members each having an affixing portion securely mounted on said bottom surface of said reinforcing panel and a biasing portion integrally extended from said affixing portion to said holding groove for biasing against a bottom surface of said top surrounding edge of the bowl.

14. The stone-top board arrangement, as recited in claim 12, wherein said mounting unit comprises a ring-shaped mounting panel, having a thickness thinner than a thickness of said reinforcing panel, integrally and radially extended from said circumferential edge of said guiding hole so as to define said holding groove between said mounting panel and said sink board to securely hold said top surrounding edge of said bowl.

15. The stone-top sink board arrangement, as recited in claim 2, wherein said mounting unit comprises at least two mounting members each having an affixing portion securely mounted on said bottom surface of said reinforcing panel and a biasing portion integrally extended from said affixing portion to said holding groove for biasing against a bottom surface of said top surrounding edge of the bowl.

16. The stone-top board arrangement, as recited in claim 2, wherein said mounting unit comprises a ring-shaped mounting panel, having a thickness thinner than a thickness of said reinforcing panel, integrally and radially extended from said circumferential edge of said guiding hole so as to define said holding groove between said mounting panel and said sink board to securely hold said top surrounding edge of said bowl.

17. The stone-top sink board arrangement, as recited in claim 1, wherein said reinforcing panel has a top surface provided with an adhesive material to firmly affix to said bottom surface of said sink board having a coarse structure.

18. The stone-top sink board arrangement, as recited in claim 17, wherein said reinforcing panel further has a plurality of receiving grooves provided on said top surface of said reinforcing panel for receiving said adhesive material, so as to enhance an adhesive ability of said reinforcing panel.

19. The stone-top sink board arrangement, as recited in claim 18, wherein said sink board further has at least a faucet through hole and said reinforcing panel further has at least a faucet positioning hole coaxially aligned with said faucet through hole of said sink board for mounting a faucet on said sink board and communicating with said bowl cavity through said faucet through hole.

20. The stone-top sink board arrangement, as recited in claim 19, further comprising at least an elongated reinforcing element embedded into said bottom surface of said sink board and positioned adjacent to said faucet through hole for substantially enhancing a stiffness of said sink board around said faucet through hole.

* * * * *